US005196653A

United States Patent [19]

Kiss

[11] Patent Number: 5,196,653

[45] Date of Patent: Mar. 23, 1993

[54] MUFFLER FOR AIR POWERED TURBINE DRIVE

[75] Inventor: Mark J. Kiss, Newport, R.I.

[73] Assignee: The United States of America as represented by the Secretary of the Navy, Washington, D.C.

[21] Appl. No.: 702,570

[22] Filed: May 20, 1991

[51] Int. Cl.[5] ..... E04F 17/04

[52] U.S. Cl. ..... 181/224; 181/229; 181/266; 181/276

[58] Field of Search ..... 181/224, 229, 235, 264, 181/265, 266, 267, 268, 270, 276, 281, 282

[56] References Cited

U.S. PATENT DOCUMENTS

| | | | |
|---|---|---|---|
| 3,073,684 | 1/1963 | Williams, Sr. | 181/264 |
| 3,754,620 | 8/1973 | Foster et al. | 181/265 |
| 4,595,073 | 6/1986 | Thawani | 181/276 X |
| 4,645,521 | 2/1987 | Freesh | 181/265 |

*Primary Examiner*—Michael L. Gellner
*Assistant Examiner*—Khanh Dang
*Attorney, Agent, or Firm*—Michael J. McGowan; Prithvi C. Lall; Michael F. Olgo

[57] ABSTRACT

A muffler for an air powered turbine drive includes a cone section made of a perforated metal, a plurality of layers of sintered material on the inner surfaces of the cone section, an inner housing section substantially surrounding the cone section, an inner baffle wall between the inner housing section and the inner cone section, and an outer housing section substantially surrounding the inner housing section. Air entering the muffler through the cone section passes outwardly through the walls of the cone section and is then redirected several times before passing outwardly from the outer housing section in order to attenuate the noise in the air leaving the muffler without creating excessive muffler pressure.

8 Claims, 1 Drawing Sheet

MUFFLER FOR AIR POWERED TURBINE DRIVE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The instant invention relates to noise abatement apparatus, and more particularly to an improved muffler for an air powered turbine drive.

(2) Description of the Prior Art

Air powered turbine drives have frequently been utilized for driving pumps, compressors, etc. However, it has been found that the air exhausted from air powered turbine drives can produce excessive levels of noise, which can be detrimental to operators or the persons in the vicinity of such drives. While various mufflers have been heretofore available for muffling the noise produced by air powered turbine drives, the heretofore available mufflers have generally been found to be ineffective for reducing the noise produced by such drives to safe levels. They have also often been found to produce excessive levels of muffler pressure, and hence they have often been found to reduce the overall efficiency levels of air powered turbine drives.

SUMMARY OF THE INVENTION

The instant invention provides an effective muffler which reduces the amount of noise produced by an air powered turbine drive without producing an excessive level of muffler pressure.

Specifically, the muffler of the instant invention comprises an inner chamber. This chamber is made up of a frustum of a right circular cone connected to a short circular duct. The duct is then capped off with an end plate. This entire surface area is perforated with circular holes comprising approximately 55 percent of the surface area. The inside of this surface area is lined with a porous sintered material. This includes the frustum, duct, and end plate. Because of the low tensile strength of sintered porous materials, the frustum and duct lining is designed to contain at least one floating joint in order to allow the material to expand and contract without causing permanent deformation of the material. Any permanent deformation would cause a change in the fluid flow characteristics of the porous material. This inner chamber will be referred to as the cone section.

The muffler includes a tubular inner channel which forms a wall extending from a point adjacent the inlet end of the inner cone section in substantially co-axial outward direction to the inner cone section side wall terminating in a free end.

The muffler also includes a housing section whose purpose is to guide the air through the housing chamber and then through two 180° turns.

The housing is made up of a short duct section capped off at the end. At some distance inside this short duct, a circular section of porous material is placed in order to form the housing chamber. The length of this section of porous material can be varied to obtain the maximum noise reduction. This duct is then attached to a tubular inner channel by a number of support vanes.

Attached to the short duct section is a larger diameter short duct section which is also attached to the tubular inner channel section. This will turn the air flow 180° and direct the air out of the muffler through the annular area formed by the combination of the two ducts just described.

It has been found that the muffler of the instant invention can be effectively utilized for significantly reducing the amount of noise produced by an air turbine drive. Specifically, it has been found that when the muffler of the instant invention is installed on an air turbine drive it can be effectively utilized for redirecting air exhausted from the turbine drive so that the air must first pass outwardly through the sintered layer in the inner cone section. It has been further found that when the muffler is installed in this manner the inner channel wall is operative for redirecting air passing outwardly through the inner cone section side wall so that it passes between the channel wall and the inner cone section side wall to the free end of the inner channel wall, and that the inner housing section is operative for redirecting both the air exhausted from between the inner cone section side wall and the inner channel wall and the air exhausted from the inner cone section end wall so that it passes along the outer side of the channel wall in a direction substantially back toward the inlet end of the inner cone section. It has been still further found that the outer housing section is operative for redirecting air passing out of the inner housing section so that it passes along the outer side of the inner housing section side wall in a direction away from the inlet end of the inner cone section and that the baffle wall is operative for causing a certain amount of the air passing outwardly through the inner cone section to pass through the baffle wall so that the noise level of the air is further attenuated. Accordingly, air passing through the muffler of the instant invention is redirected several times as it passes therethrough so that a significant amount of the noise accompanying the air is attenuated as it is reflected back toward the turbine drive and/or various interior surfaces of the components of the muffler. It has been found that as a result, the muffler of the instant invention is operative for significantly reducing the level of the noise produced from an air turbine drive.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawing wherein.

DESCRIPTION OF THE PREFERRED EMBODIMENTS

Figure 1:
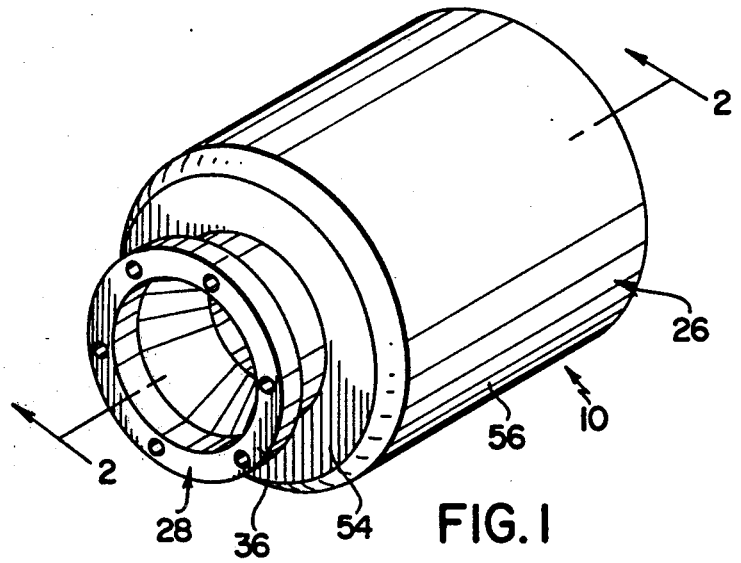
FIG. 1 is a perspective view of the muffler of the instant invention.
Figure 2:
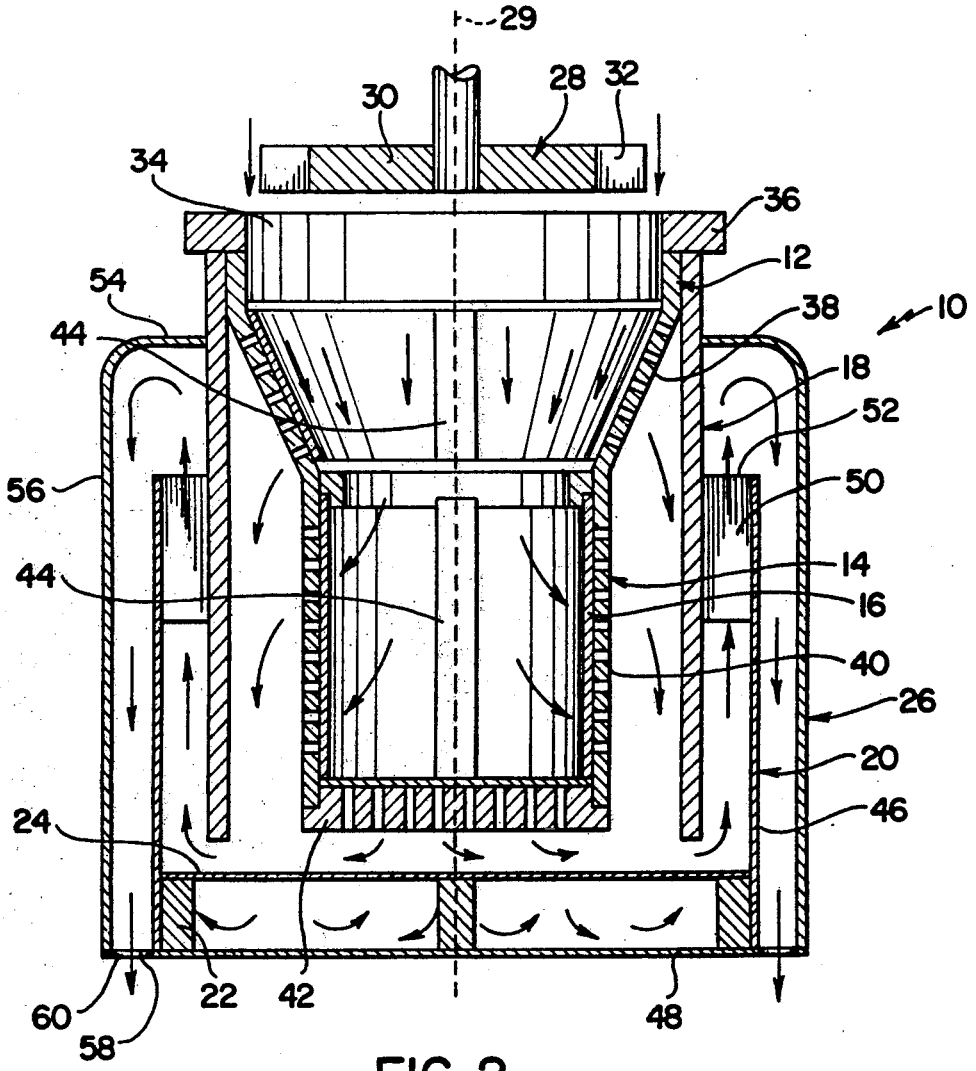
FIG. 2 is a cross-sectional view thereof taken along line 2—2 in FIG. 1.

Referring now to the drawing, the muffler of the instant invention is illustrated in FIGS. 1 and 2, and generally indicated at 10. The muffler 10 includes an inlet or mounting section generally indicated at 12, a cone section generally indicated at 14, a plurality of layers of sintered material 16 in the cone section 14, an inner channel wall generally indicated at 18, an inner housing section 20, a sintered layer 24 on inner supports 22, and an outer housing section generally indicated at 26. The muffler 10 is adapted to be secured to an air turbine drive so that air from the turbine drive passes into the muffler 10 to attenuate the noise generated from the turbine drive. Specifically, the muffler 10 is adapted to be assembled with a turbine drive so that a rotatable turbine wheel 28 thereof, having an axis 29 and comprising a body portion 30 and a plurality of turbine blades 32, is disposed adjacent the inlet housing section 12 so that air exhausted from the turbine wheel 28 passes into the cone section 14. The muffler 10 is adapted so that air exhausted into the inlet end of the cone section 14 passes through the walls of the cone section 14 and is deflected by the channel wall 18, the sintered layer 24, the inner housing 20, and the outer housing 26 in order to attenuate the noise level in the air by deflecting substantial quantities of the noise back toward other walls and/or toward the turbine wheel 28.

The inlet section 12 is preferably of tubular cylindrical configuration and it has a cylindrical cavity 34 formed therein which has a diameter which is preferably slightly larger than that of the turbine wheel 28. The inlet housing section 12 includes a mounting flange 36 for mounting the muffler 10 on an air turbine drive so that it is positioned adjacent the turbine wheel 28 and it is preferably integrally formed with the cone section 14 so that air from the inlet housing section 12 passes directly into the inlet end of the cone section 14.

The cone section 14 preferably includes a converging side wall portion 38, a substantially straight side wall portion 40, and an end wall portion 42. The converging side wall portion 38 extends integrally from the inlet housing section 12 to the substantially straight side wall portion 40 and the end wall portion 42 extends across the end of the substantially straight side wall portion 40 as illustrated. The converging side wall portion 38, the substantially straight side wall portion 40, and the end wall portion 42, are all preferably made from a perforated metal having a plurality of holes therein which create approximately 50% open area in the converging section 38, side wall portion 40 and the end wall portion 42 so that air can pass freely through the walls of the cone section 14. However, because the tapering wall portion 38 is angularly disposed relative to the axis of the turbine wheel 28, noise which is generated as the air passes through the turbine blades 32 thereof is at least partially deflected back toward the turbine wheel 28 to attenuate a portion of the noise generated by the turbine wheel 28. In this connection, although the converging wall portion 38 in the muffler 10 as herein embodied is angularly disposed relative to the axis 29 of the turbine wheel 28, other embodiments wherein the converging wall portion 38 is disposed at other angles, or even perpendicular to the axis 29, are contemplated since these other embodiments of the converging wall portion 38 also function to attenuate noise produced by the turbine wheel 28.

The sintered layer 16 preferably comprise a layer of relatively porous sintered material, such as sintered stainless steel. For example, type D sintered stainless steel manufactured by the Pall Corporation Porous Metals Division can be effectively utilized for the sintered layer 16. The sintered layer 16 preferably extends along the inner surfaces of the converging side wall portion 38, the substantially straight side wall portion 40, and the end wall portion 42. Further, the portions of the sintered layer 16 which extends along the inner surfaces of the converging side wall portion 38 and the substantially straight side wall portion 40, preferably each include at least one floating joint 44 where an overlapping layer of sintered material is provided to allow adjoining sections of the sintered layer 16 to shift slightly to allow for the expansion, and/or contraction, of the sintered layer 16 resulting from the pressure of the air exhausted from the turbine wheel 28.

The channel wall 18 is preferably of tubular configuration and it preferably extends from the inlet housing section 12 in outwardly spaced, substantially co-axial relation to the cone section 14. The channel wall 18 preferably extends in an axial direction to approximately the end of the cone section 14. Accordingly, air passing through the converging side wall portion 38 and the substantially straight side wall portion 40 is redirected by the channel wall 18 so that it passes in a direction away from the inlet section 12 to the free end of the channel wall 18.

The inner housing section 20 comprises a side wall portion 46 and an end wall portion 48. The inner housing section 20 is secured to the inner channel wall 18 with vanes 50 so that the side wall portion 46 is disposed in outwardly spaced relation to the channel wall 18, and so that the end wall 48 is disposed in axially spaced relation to both the channel wall 18 and the end wall 42 of the cone section 14. Vanes 50 are formed as radially disposed plates, and they are operative for securing the side wall portion 46 to the channel wall 18 so that the side wall portion 46 cooperates with the channel wall 18 to form an annular passageway having an annular outlet 52 through which air can freely flow. In other words, the vanes 50 are operative for securing the inner housing section 20 to the channel wall 18 so that the vanes 50 do not significantly obstruct the free flow of air through the annular open end 52. However, because of the orientation of the inner housing section 20 relative to the channel wall 18, air passing outward through the outlet 52 is redirected by the inner housing section 20 so that it passes in a direction back toward the inlet housing section 12 as it is exhausted from the inner housing section 20.

The sintered layer 24, acting as a baffle wall, rests on support 22 and it is disposed in spaced substantially parallel relation to both the end wall 48 of the inner housing section 20, and the end wall 42 of the cone section 14. In this regard, the exact position of the baffle wall 24 relative to the end wall 48 and the end wall 42 is preferably selected to produce maximum attenuation of the noise in the air from the particular turbine drive to which the muffler 10 is attached through an energy conversion to heat and by reflecting sound waves.

The sintered layer 24 is preferably also made from a conventional sintered material, such as sintered stainless steel, so that it is relatively porous and so that air can pass freely through it and into the void area between the sintered layer 24 and the end wall 48.

The outer housing section 26 is operative for further redirecting air passing outwardly from the inner housing section 20. The outer housing section 26 comprises an annular end wall 54 which extends outwardly from the channel wall 18 in spaced relation to the annular outlet 52 of the inner housing section 20. The outer housing section 26 further comprises an annular side wall portion 56 which extends from the annular end wall portion 54 in a direction generally away from the inlet housing section 12. The side wall portion 56 extends in outwardly spaced relation along the outer side of the side wall 46 of the inner housing section 20 so that it cooperates with the inner housing section 20 to define an annular air passage for exhausting air from the muffler 10. The side wall portion 56 extends along the inner housing section 20 to approximately the bottom wall 48 thereof so that it cooperates with the bottom wall 48 for defining an annular outlet 58 through which air can be exhausted from the muffler 10. The outer housing section 26 is preferably secured to the inner housing section 20 with vanes 60 which are adapted to provide minimal resistance to the free flow of air outwardly through the outlet 58.

Accordingly, during use of the muffler 10 air is exhausted from the turbine wheel 28 so that it passes into the cone section 14. A portion of the noise generated as air is passed through the turbine wheel 28 is attenuated as the noise is deflected back by the converging wall portion 38 of the cone section 14 and the sintered material thereon. Air passing through the cone section 14 is then redirected several times as it passes through the inner housing section 20 and the outer housing section 26 so that noise in the air is further deflected back toward the various walls in the interior of the muffler 10 and/or toward the turbine wheel 28. Also, flow of air and noise through the layers of porous material will cause attenuation of the noise by converting some sound energy to heat.

It is seen therefore that the instant invention provides an effective muffler for an air powered turbine drive. The muffler 10 is operative for redirecting air from the turbine wheel 28 so that noise generated by the passage of air through the turbine wheel 28 is attenuated as it passes through the muffler 10. Further, because of the construction of the muffler 10 air can pass relatively freely there through to minimize the amount of muffler pressure generated in the muffler 10. Accordingly, it is seen that the muffler 10 represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A muffler for an air powered turbine drive comprising:

an inner cone section having an inlet end and an axis and including a perforated cone section side wall extending from said inlet end to a terminal end and a perforated inner cone section end wall on the terminal end of said inner cone section side wall, whereby air entering said inner cone section through said inlet end passes outwardly through said inner cone section side wall and said inner cone section end wall;

means for securing said inner cone section to said turbine drive for receiving air exhausted therefrom through said inlet end;

inner housing means substantially enclosing said inner cone section and redirecting air passing through said inner cone section side wall and said inner cone section end wall so that it passes in a direction substantially back toward said inlet end through an annular inner housing means outlet;

outer housing means surrounding at least a portion of said inner housing means for reversing the direction of the air from said inner housing means outlet;

an inner channel wall between said inner cone section side wall and said inner housing means, said inner channel wall being spaced outwardly from said inner cone section side wall for substantially reversing the direction of the air from said inner housing and redirecting air passing through said inner cone section side wall in a direction away from said inlet end before it passes into said inner housing means; and a layer of sintered material for each of said cone section side wall and said cone section end wall having inner and outer sides, and a plurality of layers of sintered material on the sides of said cone section side wall and said inner cone section end wall, before air entering said inner cone section through said inlet end passing through said layer of sintered material before passing outwardly through said cone section side wall and said inner cone section end wall.

2. In the muffler of claim 1, said plurality of layers of sintered material having at least one floating joint therein for enabling said layer of sintered material to conform to the inner side of said inner cone section side wall.

3. In the muffler of claim 1, said inner housing means including an inner housing side wall which is spaced outwardly from said inner cone section side wall and an inner housing end wall on said inner housing side wall, said inner housing end wall being spaced from said cone section end wall.

4. The muffler of claim 3 further, comprising a sintered material baffle wall in said sintered material housing means, said inner baffle wall being interposed in spaced relation between said inner cone section end wall and said inner housing end wall.

5. In the muffler of claim 1, said cone section including a converging section having an inlet diameter and an outlet diameter which is less than said inlet diameter.

6. A muffler for an air powered turbine drive comprising:

cone section having an inlet end and an axis and including a perforated inner cone section side wall extending from said inlet end to a terminal end and a perforated inner cone section end wall on the end of said inner cone section side wall, whereby air entering said inner cone section through said inlet end passes outwardly through said inner cone section side wall and said inner cone section end wall;

means for securing said inner cone section to said turbine drive for receiving air exhausted therefrom through said inlet end;

a tubular inner channel wall extending from a point adjacent said inlet end in outwardly spaced substantially coaxial relation to said inner cone section side wall terminating in an end;

an inner housing section including an inner housing section side wall having first and second ends and an inner housing section end wall on the second end of said inner housing section side wall, said inner housing section side wall being spaced outwardly in substantially coaxial relation from said inner channel wall, said inner housing section end wall being spaced from both said inner cone section end wall and said inner channel end wall;

a tubular outer housing section including an annular end wall extending outwardly from said inner channel wall in spaced relation to the first end of said inner housing section end wall and a tubular outer housing section side wall extending from said outer housing section end wall in outwardly spaced relation along said inner housing section side wall; and a layer of sintered material on the inner sides of said inner cone section side wall and said inner cone section end wall.

7. The muffler of claim 9, further comprising a perforate inner baffle wall in said inner housing section, said inner baffle wall being disposed in spaced relation to said inner cone section end wall and said inner housing section end wall and being interposed therebetween.

8. The muffler of claim 7, further comprising a layer of sintered material on said inner baffle wall between said inner baffle wall and said cone section end wall.

* * * * *